US006681692B2

(12) United States Patent
Beran et al.

(10) Patent No.: US 6,681,692 B2
(45) Date of Patent: Jan. 27, 2004

(54) SELF-ADJUSTING BLADE

(75) Inventors: Antoine Beran, Lausanne (CH); Silvano Freti, St. Prex (CH)

(73) Assignee: BTG Eclépens S.A., Eclépens (CH)

( * ) Notice: Subject to any disclaimer, the term of this patent is extended or adjusted under 35 U.S.C. 154(b) by 109 days.

(21) Appl. No.: 10/071,096

(22) Filed: Feb. 11, 2002

(65) Prior Publication Data

US 2002/0157548 A1 Oct. 31, 2002

(30) Foreign Application Priority Data

Feb. 16, 2001 (SE) ..... 0100505

(51) Int. Cl.[7] ..... B41F 9/10; B41F 1/00; B41F 35/00

(52) U.S. Cl. ..... 101/157; 101/169; 101/425; 118/409; 118/642; 37/266; 15/236.1; 30/169

(58) Field of Search ..... 101/157, 169, 101/425; 118/642, 409; 37/266; 15/236.1; 30/169

(56) References Cited

U.S. PATENT DOCUMENTS

| | | | | | |
|---|---|---|---|---|---|
| 3,703,019 | A | | 11/1972 | Bratt | |
| 4,184,429 | A | * | 1/1980 | Widmer | 101/169 |
| 4,434,522 | A | * | 3/1984 | Linzberger | 15/256.51 |
| 4,770,253 | A | * | 9/1988 | Hallissy et al. | 172/701.3 |
| 5,824,154 | A | * | 10/1998 | Freti | 118/126 |
| 6,207,021 | B1 | * | 3/2001 | Eriksson et al. | 162/281 |
| 6,305,282 | B1 | * | 10/2001 | Datwyler | 101/169 |
| 6,431,066 | B1 | * | 8/2002 | Perez et al. | 101/350.6 |

FOREIGN PATENT DOCUMENTS

| | | | |
|---|---|---|---|
| EP | 0 672 761 | | 9/1995 |
| GB | 2 130 924 | | 6/1984 |
| GB | 2257084 | * | 6/1993 |
| WO | 88/10155 | | 12/1988 |
| WO | 97/41299 | | 11/1997 |

* cited by examiner

*Primary Examiner*—Edward Lefkowitz
*Assistant Examiner*—Marvin P. Crenshaw
(74) *Attorney, Agent, or Firm*—Burns, Doane, Swecker & Mathis, L.L.P.

(57) ABSTRACT

A self-adjusting blade for engagement with a moving work surface, comprising a steel strip elongated in a first direction between first and second sides, said strip having an edge section along said first side for contact with said work surface, and said edge section being hardened to a hardness exceeding that of the remaining part of said strip. The self-adjusting blade is provided with a coating of a low wear resistance material covering substantially all of said edge section at least on the part thereof contacting the work surface.

20 Claims, 1 Drawing Sheet

SELF-ADJUSTING BLADE

TECHNICAL FIELD

The present invention relates to self-adjusting blades for engagement with a moving work surface, said blades being useful for coating, creping, doctoring and other scraping operations in the printing industry, in flexogravure or rotogravure techniques.

TECHNICAL BACKGROUND AND STATE OF THE ART

Although the present invention is not restricted hereto it will in the following be described mainly in relation to the coating of paper substrates.

Blades used in conventional coating techniques are usually made of different types of materials. Among such materials there may be mentioned high-strength, hardened and tempered carbon steels, blade substrates covered at the edge or tip with ceramic hard wear-resistant materials, such as described in British patent 2 130 924, and low alloyed steel with local hardening of the edge section, as described in EP 0 672 761.

Blades made of hardened and tempered carbon steel exhibit quite poor wear resistance behaviour and have to be replaced frequently in view of the abrasive wear caused by the base paper and the coating colour pigments. Their hardness is typically within the range 500 to 600 HV depending on the thickness of the steel strip.

On the other hand the low abrasion resistance of such steel blades allows a short self-adjusting period when installed in a coater machine. This makes the blade easy to use and non-sensitive to the exact coater setting or to existing unevenness in geometrical conditions along the blade holder. This is especially important for coating using stiff blade mode, i.e. when the angle between the tip of the blade and the paper on the coater is high, usually 10° or more.

Another feature of carbon steel blades is their behaviour of wear at the site of coating colour entrance in stiff blade mode. According to the literature (Schachtel et al., Wochenblatt far Papierfabrikation 16–1993, p 661–667) a round wear form can be obtained (see FIG. 1 of the literature reference). A small but visible radius (r) is formed at the entrance site of contact between the blade and the base paper. This radius results by the combination of erosive effect of the coating colour impingement and the abrasive effect of the paper fibres. Such feature is of primary interest for rotogravure type of coating recipe, where the pigments are mainly constituted by platelets with a high shape factor. The existence of such a radius (r) assists in the proper orientation of the coating colour pigments before passing beneath the blade resulting in optimum printability characteristics.

Hard material tipped blades, such as blades with a ceramic coating, as well as edge section hardened low alloy steel blades perform better than carbon steel blades in terms of life period. Blades tipped with hard material exhibit typical hardness values of the tip in the range from 900 to 1200 HV, while the locally hardened edge section of low alloy steel blades reaches about 800 HV, the rest of the blade reaching about 600 HV.

Although the wear resistance property is an important factor in the industrial interest for such blades, such property is at the same time a limitation in their use in view of the necessity to adapt specifically each tip design according to the exact running condition of the blade and the setting of the blade holder in the coating machine. The high wear resistance does not allow incorrect setting because it will take too long to adjust the bevel in a running-in period. This is normally not acceptable in industrial coating conditions and could result in poor MD and CD profiles of the coated paper and/or poor surface quality. Furthermore, the rounding of the entrance point as described above will not be formed as readily.

BRIEF SUMMARY OF THE INVENTION

The features described above form the basis for resolving the problems encountered with the prior art and the invention seeks to provide a solution wherein the advantages of using materials of high wear resistance are combined with the advantages of using materials of lower wear resistance.

One object of the invention is, accordingly, to provide a blade which will behave similarly to a carbon steel blade when loaded and during the running-in period, i.e. obtaining self-adjusting performance of the blade.

Another object of the invention is to provide a blade which after a short running-in period will behave in the same way as a locally hardened edge section of a low alloy steel blade resulting in high wear resistance performance.

Still another object of the invention is to provide a blade capable of wear to result in a rounded entrance contact site, with the major part of the metering surface in contact with the base paper and the coating colour performs similarly to low alloy steel blades with a local hardened section.

For these and other objects which will be clear from the following disclosure the invention provides for a self-adjusting blade for engagement with a moving work surface. The blade comprises a steel strip elongated in a first direction between first and second sides, said strip having an edge section along said first side for contact with said work surface, and said edge section being hardened to a hardness exceeding that of the remaining part of said strip. Said second side is intended for attachment to a blade holder in a conventional manner. The blade according to the invention is characterized by a coating of a low wear resistance material covering substantially all of said edge section at least on the part thereof contacting the work surface.

According to one embodiment of the invention said steel strip is constituted by a low alloyed steel hardened to a hardness of between about 400 and 600 HV, said edge section being further hardened to a hardness of between about 700 and 900 HV.

A preferred embodiment of such blade is one wherein said steel strip is constituted by a cold rolled hardened and tempered strip having the composition (percent by weight):

C 0.46–0.70;
Si 0.2–1.5;
Mn 0.1–2.0;
Cr 1.0–6.0;
Mo 0.5–5;
V 0.5–1.5;
B>0.01;
Ni≦1.0;
Nb≦0.2.

The material of low wear resistance has suitably a hardness between about 200 and 600 HV. Suitable materials are pure metals, alloys, oxides, polymers, or mixtures of two or more thereof.

It is particularly preferred that said material of low wear resistance is selected from molybdenum containing up to 4% $O_2$, Ni- or Co-based alloys, Cu-based alloy, AlSi/polyester blends or Co-base polymer blends, or stainless steel.

For ease of adaptation to the moving surface the edge section of the blade is preferably provided with a bevel on the side thereof contacting the moving surface.

The thickness of the blade substrate can vary from about 0.15 to about 0.8 mm. The thickness of the self-adjusting coating suitably lies within the range about 1 to about 100 $\mu$m, preferably 20 to 50 $\mu$m.

DETAILED DESCRIPTION OF THE INVENTION

Figure 1:
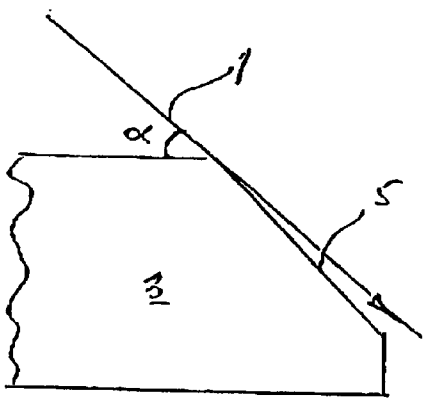
FIGS. 1 and 2 show diagrammatically two types of incorrect setting of the blade vis-à-vis the moving surface.
Figure 2:
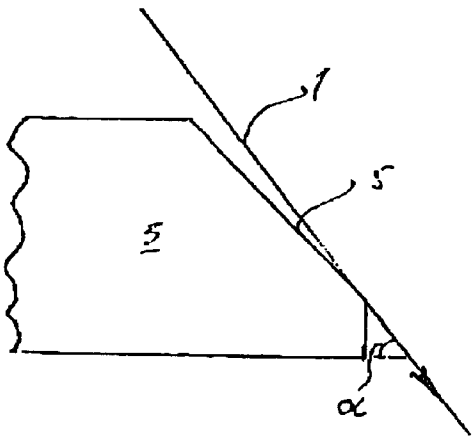
Figure 3:
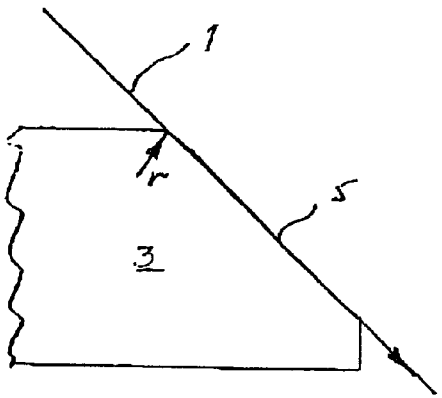
FIG. 3 shows diagrammatically the surf ace of engagement of the blade after the running-in period.

FIGS. 1 to 3 of the drawing show diagrammatically the operating part of a carbon steel blade operating under stiff mode, i.e. the angle $\alpha$ being at least about 20°. The moving surface 1 of for example a backing roll in paper coating travels in the direction of the arrows. The operating part of blade 3 is provided with a bevel 5 for adaptation to the moving surface.

FIG. 1 shows the situation in relation to a newly installed blade 3, the setting being slightly incorrect on the heel. FIG. 2 shows another situation of incorrect setting on the toe. FIG. 3 shows the blade 3 after a short running-in period, the blade being adjusted by wear to correct contact with the running surface 1 and a small radius (r) being formed at the entrance point.

Figure 4:
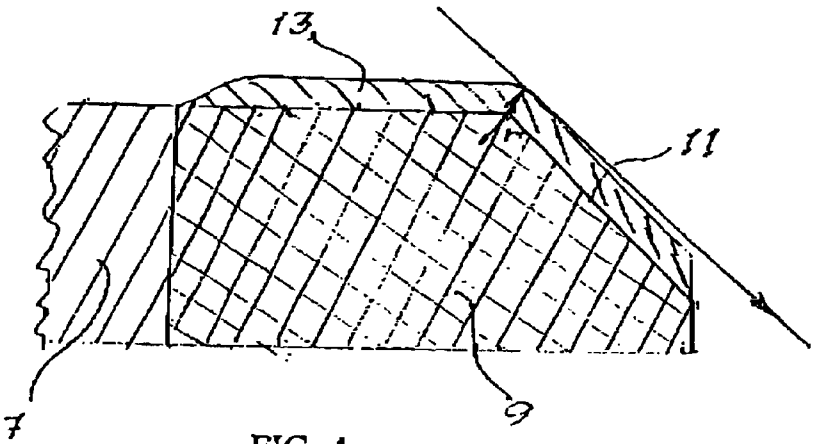
FIG. 4 shows diagrammatically in a cross-section of a detail of a blade in accordance with the present invention.

FIG. 4 shows a blade designed in accordance with the present invention. A steel strip 7 hardened and tempered to a hardness of about 600 EV has an edge section 9 further hardened and tempered to a hardness of about 780 HV. A preferred steel strip for use in the blade according to the invention is the Uddeholm Strip Longlife Coater Blade (Uddeholm Strip Steel AB, Munkfors, Sweden).

On the edge section 9 of the steel strip 7 bevelled with a given bevel 11, a layer of a material with self-adjusting performance is added, This coating 13 should have a hardness of between about 100 and 600 HV, preferably about 100 to 400 HV. The coating 13 can be of any material having the hardness indicated and can be selected from a broad group of materials, such as metals, alloys, low hardness oxides or oxide mixtures, polymers, or mixtures or composites thereof. A preferred material is a material of a metallic nature, which can be applied by spraying using plasma, arc wire or HVOP. The material can also be applied by galvanic or thin film techniques, such as PVD, CE PVD, etc. A particularly preferred coating material is a copper-based alloy, such as a copper-aluminum alloy applied by plasma spraying as described in an example below.

The present invention will now be further described by specific examples which, however, are not to be construed to restrict the scope of invention. In these examples parts and percentages are by weight if not otherwise indicated.

EXAMPLE 1

A comparative test was carried out on a pilot coater, using conventional edge section hardened low alloy steel and a self-adjusting blade according to the present invention.

The conditions were:

| | |
|---|---|
| Base paper: | 34 g/m$^2$ (Stora Enso) |
| Coating colour formulation: | typical rotograde |
| 80 dry parts | Kaolin suprasmooth (Imerys) |
| 20 dry parts | Talc Helicoat 533 GR (Luzenac) |
| 5 dry parts | Acrilic latec pr8763x (BASF) |
| 1 dry part | Calcium stearate C104 (Nopcoat) |
| Solid content: | about 56% |
| Viscosity: | about 1000 mPa:s |
| Coater conditions: | roll applicator, Beloit S-matic head |
| Speed | 1200 m/min |
| Blade thickness: | 0.381 mm |
| Blade bevel: | 45° (stiff mode) Blade setting on the toe (48 to 49°) |
| Targeted coat-weight: | 8 g/m$^2$ per side |

The steel blade had an edge section hardened tip from Uddeholm (called "reference"). The blade according to the invention was made of the same steel substrate as the steel blade used as reference, i.e. edge section hardened tip from Uddeholm with a copper-aliminum alloy as top layer (Sulzer Metco Diammalloy 1004) applied by atmospheric plasma spraying, ground to a layer of about 50 microns after spraying (called "invention").

The results obtained on the coated paper quality after short pilot trials (about 20 min) were:

| | | |
|---|---|---|
| Reference: | 8.7 gloss | (Gardner) |
| Invention: | 9.7 gloss | (Gardner) |

Burn-out tests were analysed using the Keops mottling test (Techpap-F) and the results are given in the table below.

TABLE

| | Sample | Mottling index | Standard deviation |
|---|---|---|---|
| Reference | 4015 4/F1 side 1 | 65.88 | 2.08 |
| | 4015 5/F2 side 2 | 75.44 | 3.78 |
| Invention | 4015 6/F1 side 1 | 59.64 | 3.07 |
| | 4015 7/F2 side 2 | 69.58 | 3.23 |

In this test the lower the mottling index the better the fibre coverage.

The improvement in the gloss number as well as in the burn-out test is relevant. The blade of the present invention allows to rapidly achieve a good coating quality in reducing the tine of the running-in period.

EXAMPLE 2

A real trial was carried out on an off-line coater with the following conditions:

| | |
|---|---|
| Base paper: | 70 g/m$^2$ |
| Coating heads: | 1 and 2 (precoat) |
| Speed: | about 900 m/min |
| Coatweight: | about 10 g/m$^2$ per side |
| Blade holder angle: | 39° |
| Blade thickness | 0.381 mm |
| Blade type: | same as in Example 1, with 35° bevel (stiff mode) |
| Life time: | 6½ hours |

The geometrical analysis of the worn blade shows a rounded shape at the coating colour entrance, according to the description of the invention. In this specific case, the value measured for the radius (r) is about 100 microns. This confirms the ability of the low wear resistant layer to adapt the shape of the heel to the coating colour flow as a normal steel blade, as described in the technical background and state of the art.

What is claimed is:

1. A self-adjusting blade for engagement with a moving work surface, comprising a steel strip elongated in a first direction between first and second sides, said strip having an edge section along said first side for contact with said work surface, and said edge section having a hardness exceeding that of the remaining part of said strip, characterized by a coating of a low wear resistance material having a lower wear resistance than said edge section, said coating covering substantially all of said edge section at least on the part thereof contacting the work surface, the coating thereby being adapted to wear down during a running-in period.

2. A self-adjusting blade according to claim 1, wherein said steel strip is constituted by a low alloyed steel hardened to a hardness of between about 400 and 600 HV, said edge section being further hardened to a hardness of between about 700 and 900 HV.

3. A self-adjusting blade according to claim 2, wherein said low wear resistance material has a hardness between about 100 and 600 HV.

4. A self-adjusting blade according to claim 3, wherein said steel strip is constituted by a cold rolled hardened and tempered strip having the composition (percent by weight);
C 0.46–0.70;
Si 0.2–1.5;
Mn 0.1–2.0;
Cr 1.0–6.0;
Mo 0.5–5;
V 0.5–1.5;
B 0.01;
Ni 1.0; and
Nb 0.2.

5. A self-adjusting blade according to claim 3, wherein said edge section is provided with a bevel.

6. A self-adjusting blade according to claim 2, wherein said steel strip is constituted by a cold rolled hardened and tempered strip having the composition (percent by weight);
C 0.46–0.70;
Si 0.2–1.5;
Mn 0.1–2.0;
Cr 1.0–6.0;
Mo 0.5–5;
V 0.5–1.5;
B 0.01;
Ni 1.0; and
Nb 0.2.

7. A self-adjusting blade according to claim 6, wherein said edge section is provided with a bevel.

8. A self-adjusting blade according to claim 2, wherein said edge section is provided with a bevel.

9. A self-adjusting blade according to claim 1, wherein said low wear resistance material has a hardness between about 100 and 600 HV.

10. A self-adjusting blade according to claim 9, wherein said steel strip is constituted by a cold rolled hardened and tempered strip having the composition (percent by weight);
C 0.46–0.70;
Si 0.2–1.5;
Mn 0.1–2.0;
Cr 1.0–6.0;
Mo 0.5–5;
V 0.5–1.5;
B 0.01;
Ni 1.0; and
Nb 0.2.

11. A self-adjusting blade according to claim 9, wherein said edge section is provided with a bevel.

12. A self-adjusting blade according to claim 1, wherein said steel strip is constituted by a cold rolled hardened and tempered strip having the composition (percent by weight);
C 0.46–0.70;
Si 0.2–1.5;
Mn 0.1–2.0;
Cr 1.0–6.0;
Mo 0.5–5;
V 0.5–1.5;
B 0.01;
Ni 1.0; and
Nb 0.2.

13. A self-adjusting blade according to claim 12, wherein said material is selected from pure metals, alloys, oxides, polymers, or mixtures thereof.

14. A self-adjusting blade according to claim 13, wherein said material is selected from molybdenum containing up to 4% $O_2$, Ni- or Co-based alloys, Cu-based alloy, AlSi/polyester blends or Co-base polymer blends, or stainless steel.

15. A self-adjusting blade according to claim 14, wherein said edge section is provided with a bevel.

16. A self-adjusting blade according to claim 14, wherein said material is constituted by a copper-aluminum alloy.

17. A self-adjusting blade according to claim 16, wherein said edge section is provided with a bevel.

18. A self-adjusting blade according to claim 13, wherein said edge section is provided with a bevel.

19. A self-adjusting blade according to claim 12, wherein said edge section is provided with a bevel.

20. A self-adjusting blade according to claim 1, wherein said edge section is provided with a bevel.

* * * * *